US011280138B2

(12) United States Patent
Beretta et al.

(10) Patent No.: US 11,280,138 B2
(45) Date of Patent: Mar. 22, 2022

(54) ARTICULATED SUPPORT FOR A DRILLING MAST OF A DRILLING MACHINE AND RELATED DRILLING MACHINE

(71) Applicant: BERETTA ALFREDO S.R.L., Besana Brianza (IT)

(72) Inventors: Romeo Beretta, Besana Brianza (IT); Vincenzo Londra, Carugo (IT)

(73) Assignee: BERETTA ALFREDO S.R.L., Besana Brianza (IT)

( * ) Notice: Subject to any disclaimer, the term of this patent is extended or adjusted under 35 U.S.C. 154(b) by 0 days.

(21) Appl. No.: 17/048,761

(22) PCT Filed: Apr. 18, 2019

(86) PCT No.: PCT/IB2019/053231
§ 371 (c)(1),
(2) Date: Oct. 19, 2020

(87) PCT Pub. No.: WO2019/202549
PCT Pub. Date: Oct. 24, 2019

(65) Prior Publication Data

US 2021/0180411 A1 Jun. 17, 2021

(30) Foreign Application Priority Data

Apr. 20, 2018 (IT) ..... 102018000004757

(51) Int. Cl.
*E21B 15/04* (2006.01)
*E21B 7/02* (2006.01)
(Continued)

(52) U.S. Cl.
CPC ..... *E21B 15/04* (2013.01); *E21B 7/02* (2013.01); *E21B 15/00* (2013.01); *E21B 19/00* (2013.01)

(58) Field of Classification Search
CPC ..... E21B 15/00; E21B 19/00; E21B 7/02
See application file for complete search history.

(56) References Cited

U.S. PATENT DOCUMENTS 4,445,663 A 5/1984 Goyarts
9,777,459 B2 * 10/2017 Zuritis ..... E02F 3/42
2018/0258699 A1 * 9/2018 Comacchio ..... E21B 15/045

FOREIGN PATENT DOCUMENTS

DE 29711628 U1 12/1997
EP 1696100 A1 8/2006
(Continued)

OTHER PUBLICATIONS

International Search Report and Written Opinion for Corresponding International Application No. PCT/IB2019/053231 (14 Pages) (dated Jul. 12, 2019).

*Primary Examiner* — Giovanna Wright
*Assistant Examiner* — Jonathan Malikasim
(74) *Attorney, Agent, or Firm* — Lucas & Mercanti, LLP

(57) ABSTRACT

An articulated support for mast devices of drilling machines, as well as a relative drilling machine, which allows the mast device to rotate by more than 90° from one side to the other with respect to a direction of advancement of the drilling machine is disclosed. The articulated support includes a main body and two rotating bodies, first and second, pivoted to the central body along a same axis and one independently from the other. A linear actuator is pivoted on the main body and is configured to rotate the first rotatable body with respect to the main body around this axis of rotation. Another linear actuator is pivoted on the first rotatable body and is configured to rotate the second rotatable body with respect to the first rotatable body about this axis of rotation. The second rotatable body includes a support to fix a mast device.

7 Claims, 10 Drawing Sheets

(51) Int. Cl.
*E21B 15/00* (2006.01)
*E21B 19/00* (2006.01)

(56) References Cited

FOREIGN PATENT DOCUMENTS

| | | | |
|---|---|---|---|
| EP | 2428636 | A1 | 3/2012 |
| EP | 2781683 | A1 | 9/2014 |

* cited by examiner

ARTICULATED SUPPORT FOR A DRILLING MAST OF A DRILLING MACHINE AND RELATED DRILLING MACHINE

CROSS-REFERENCE TO RELATED APPLICATIONS

This application is a 371 of PCT/IB2019/053231, filed Apr. 18, 2019, which claims the benefit of Italian Patent Application No. 102018000004757, filed Apr. 20, 2018.

TECHNICAL FIELD

The present disclosure concerns the machines for making holes in the ground or holes in walls. More specifically it relates to an articulated support of a so-called "mast" device for a hydraulic drilling machine and a relative hydraulic drill to carry out vertical, horizontal or inclined perforations.

BACKGROUND

Drilling machines (hereafter simply "drills") are known to make vertical or inclined holes in the ground, for foundations or for planting poles, or horizontal holes in the walls, for passing tie rods. These machines are essentially equipped with a rotation head (or drilling head) for transmitting motion to a drill rod ending with a drilling tool, from a carriage that supports the drilling head and that is moved along a guide antenna. Usually, the term "mast" means the device composed of the assembly of the carriage, the rotation head and the guide antenna.

Typically, the mast device is mounted on a motor-driven tracked wagon through an appropriate articulation mechanism that allows to determine the angular position of the mast device according to the type of drilling to be performed.

Sometimes it is required that the drilling machines be able to perform drilling operations with the drilling tool positioned in front of a wall to be drilled (Front The Wall mode or more briefly FTW). To this end, the articulation mechanism comprises two hydraulic pistons that can be actuated in a coordinated manner to determine a desired angular variation of the drilling tool. Each piston has on the stem a pin pivoted on a rotating joint; when the mast device has to be rotated for example on the right side, the pin on the left piston must be removed to prevent mechanical interference from the left piston with a vertical pin around which the drilling tool rotates. Similarly, to rotate the mast device on the left side it is necessary to put first the pin on the left piston, which had been removed before, and to remove the pin on the right piston.

It is known from the European patent EP1696100 a hydraulic drilling machine having an articulated support which allows to operate in FTW mode without decoupling the pistons, still allowing the drilling tool to be rotated left and right by a total angle of about 180°. This articulated support has a fifth wheel positioned with the vertical or horizontal axis around which the drilling tool rotates, so that the two pistons do not interfere with the vertical rotation pin of the tool. The two pistons therefore work simultaneously until one of the two goes beyond the vertical pin on which the drilling tool is pivoted: when this happens, the piston that has passed the axis is hydraulically disabled by a valve to avoid a mechanical break of the stem.

SUMMARY

It has been found and it is the object of this disclosure an articulated support for mast devices of drilling machines, as well as a relative drilling machine, which overcomes the aforementioned limitations and allows to rotate a mast device even of more than 90° on one side and on the other side in respect to a direction of advancement of the drilling machine.

This outstanding result was obtained thanks to an articulated support for mast devices as defined in claim 1, which comprises a main body and two rotating bodies, first and second, hinged to the central body along a same axis and one independently of the other. A linear actuator is pivoted on the main body and is configured to rotate the first rotatable body with respect to the main body around this axis of rotation. Another linear actuator is pivoted on the first rotatable body and is configured to rotate the second rotatable body with respect to the first rotatable body around said axis of rotation. On the second rotatable body there is a support to fix a mast device.

The claims as filed are an integral part of this description and are incorporated herein by express reference.

DETAILED DESCRIPTION

Figure 1:
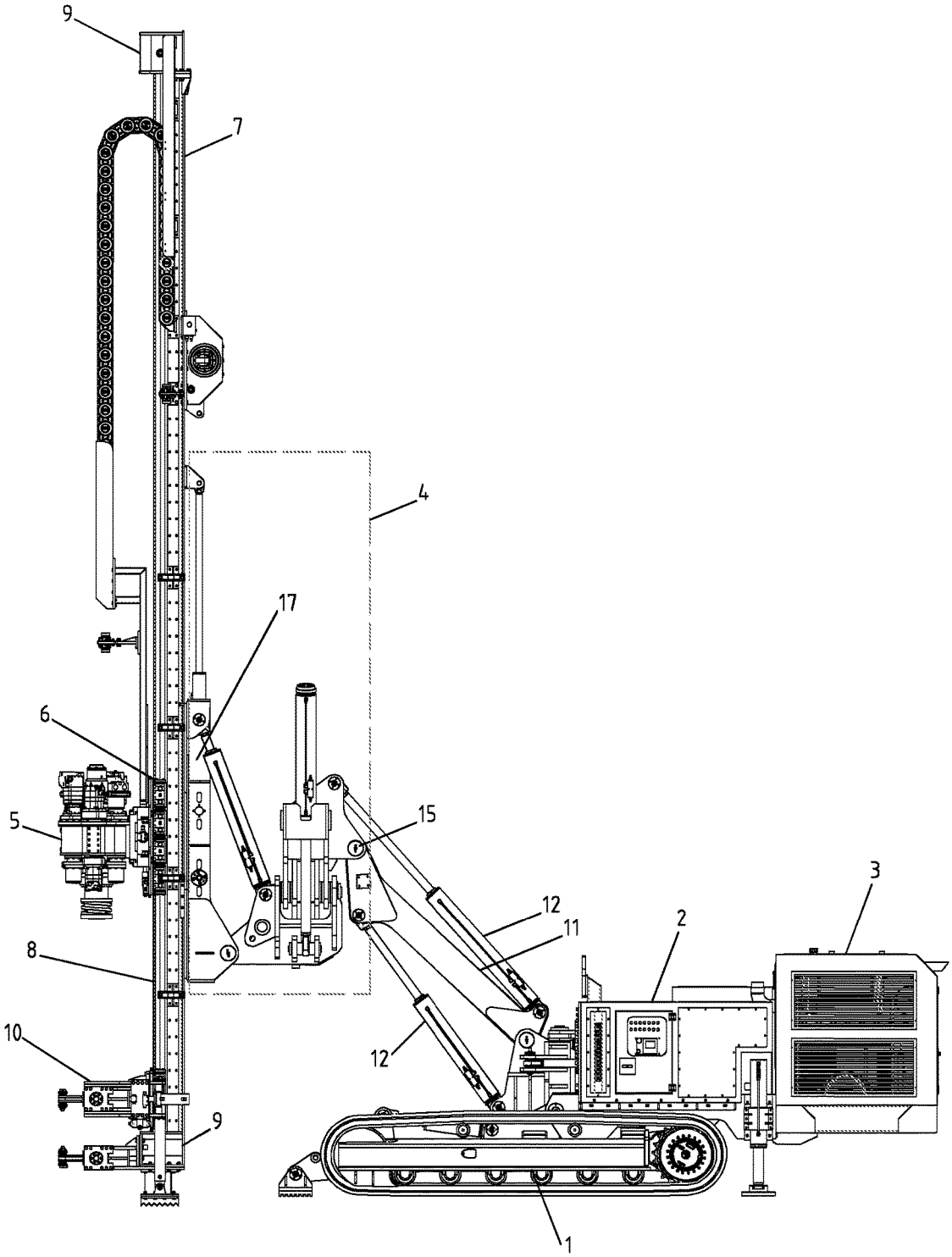
FIG. 1 is a profile view of a drilling machine in FTW configuration with an articulated support of a mast device according to the present disclosure, highlighted in the dashed box.

A drilling machine according to the present disclosure is illustrated in FIG. 1. It comprises a motor-driven tracked vehicle 1, with a central frame 2 on which at least one hydraulic system, an electrical system and a fuel tank are installed, and a rear frame 3 on which a motor of the tracked vehicle 1 is mounted, together with hydraulic pumps and an oil tank of the hydraulic circuit. The drilling machine also comprises an articulated support 4, highlighted by the dashed box, to orient the machine mast device in space, consisting of the carriage 6, the rotation head 5 and the guide antenna 7.

The rotation head 5 is mounted on a carriage 6 which slides along the guide antenna 7 positioned vertically or in another inclined position. A rope or a chain 8 is connected at the upper part and at the lower part of the carriage 6 of the rotation head 5. The rope or chain runs on two pulleys 9 positioned at the ends of the guide antenna 7, and is closed in a loop around the guide antenna 7 and around the pulleys 9. A hydraulic motor or a piston moves the carriage 6 by means of the rope or chain 8, lowering the carriage 6, and therefore the rotation head 5, to drill the ground, or to lift it to extract the drill rods (not shown). The figure also shows a set of clamps 10 for removing the rods after perforation, and possibly also the covering tubes when present.

The articulated support 4, supported by the arm 11 and moved by the linear actuators 12 pivoted to the central frame 2, allows multiple types of inclinations, such as for example:

- a vertical position of the mast device for making holes in front of the drilling machine;
- a vertical position of the mast device for making holes at the right or left side of the tracked vehicle;
- a horizontal position of the mast device for the execution of horizontal and also sub-horizontal holes at various heights from the ground;
- an inclined position of the mast device for making holes with different inclinations at the front of the machine;
- an inclined position of the mast device for making holes with different inclinations at the right and left sides of the machine.

Figure 2:
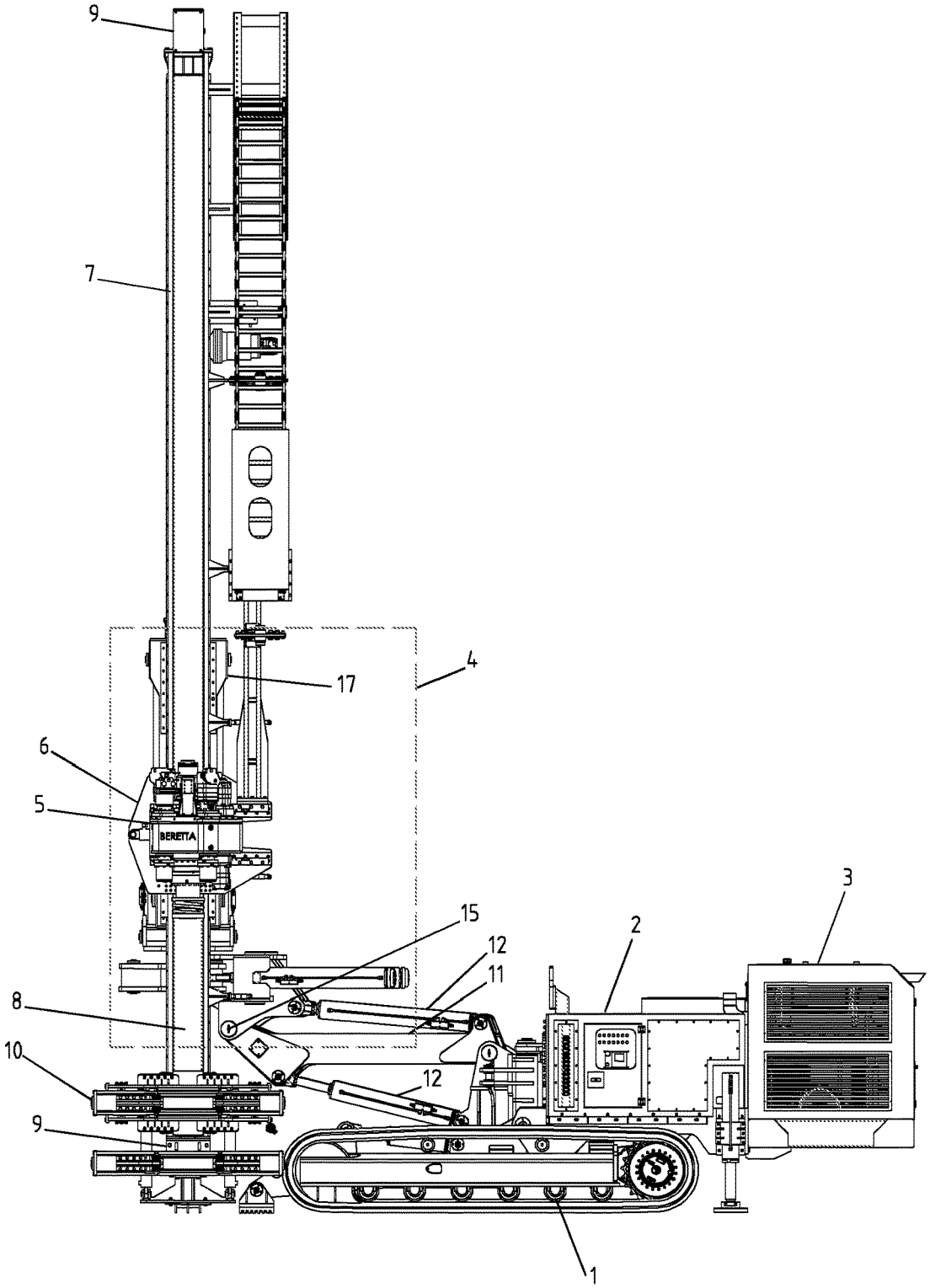
FIG. 2 shows the drilling machine of FIG. 1 with the drilling tool rotated by 90° with respect to the advancement direction of the tracked vehicle.
Figure 3:
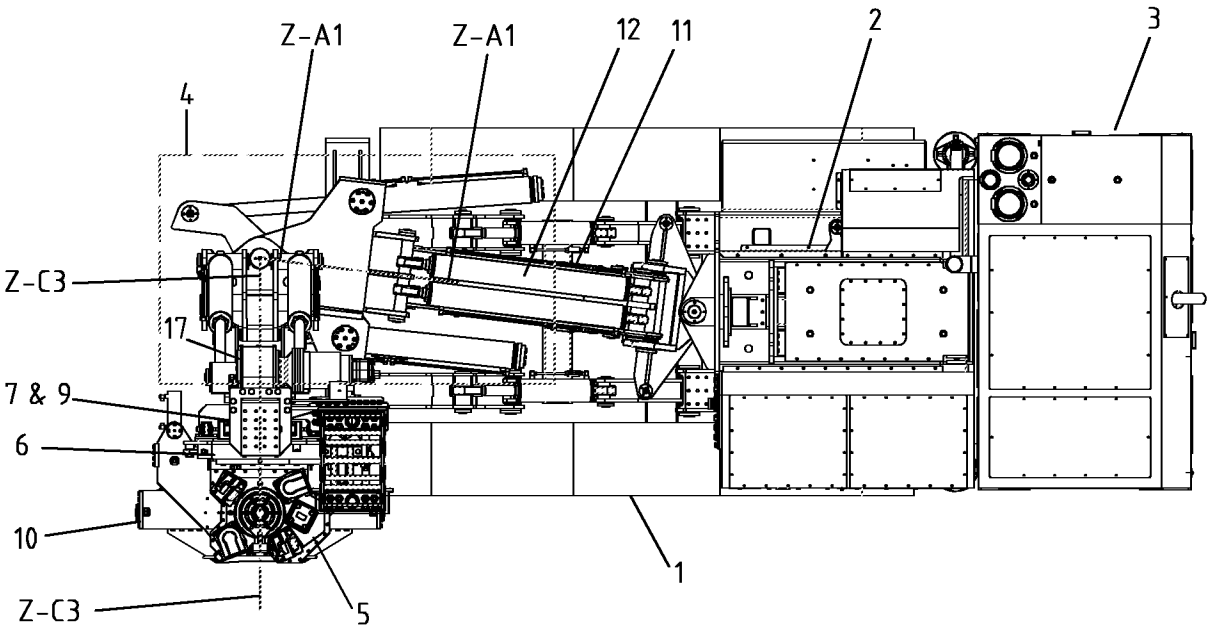
FIG. 3 is a top view of the drilling machine in the configuration of FIG. 2.
Figure 4:
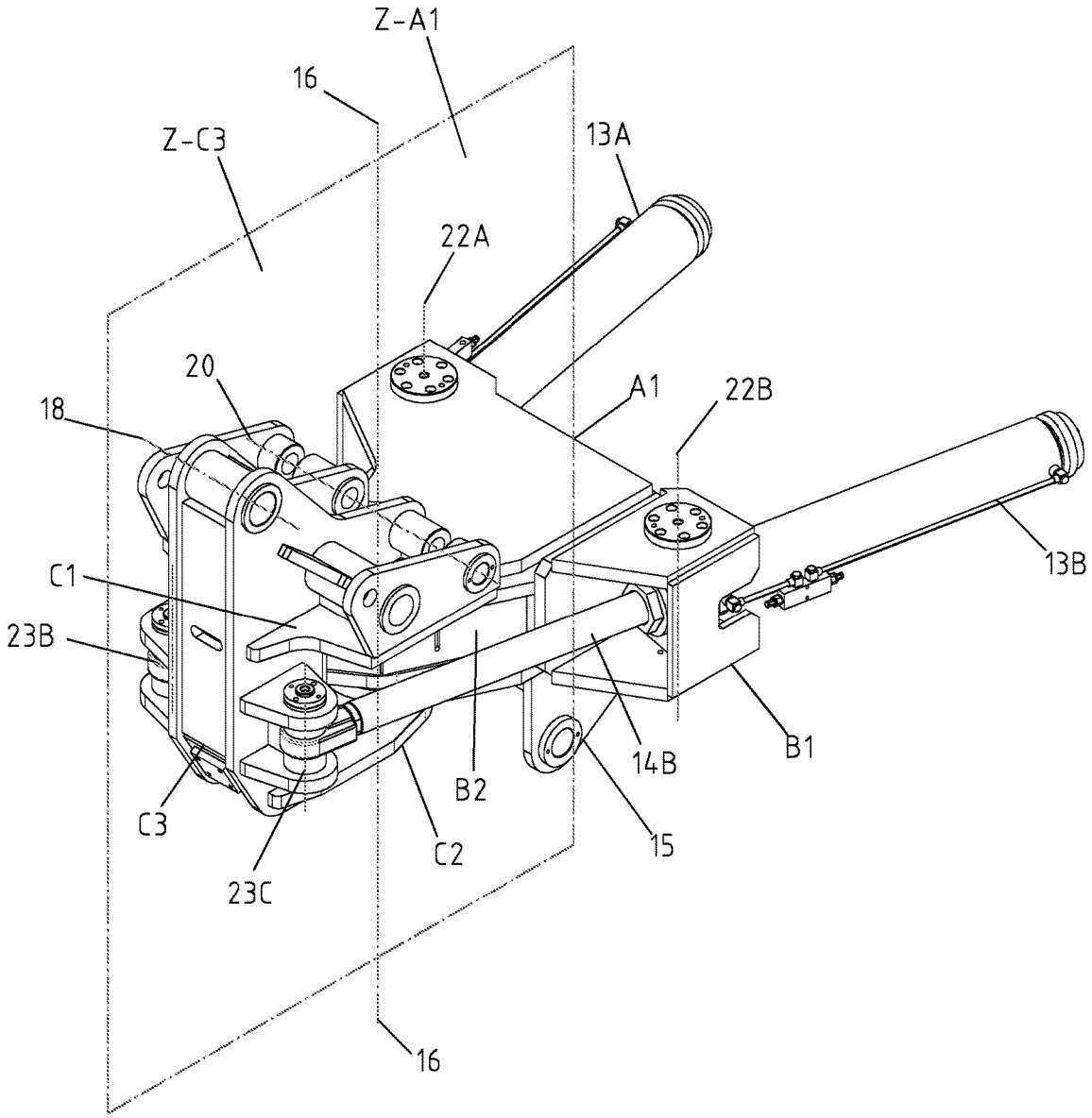
FIG. 4 is a perspective view of a support articulated according to the present disclosure.
Figure 5:
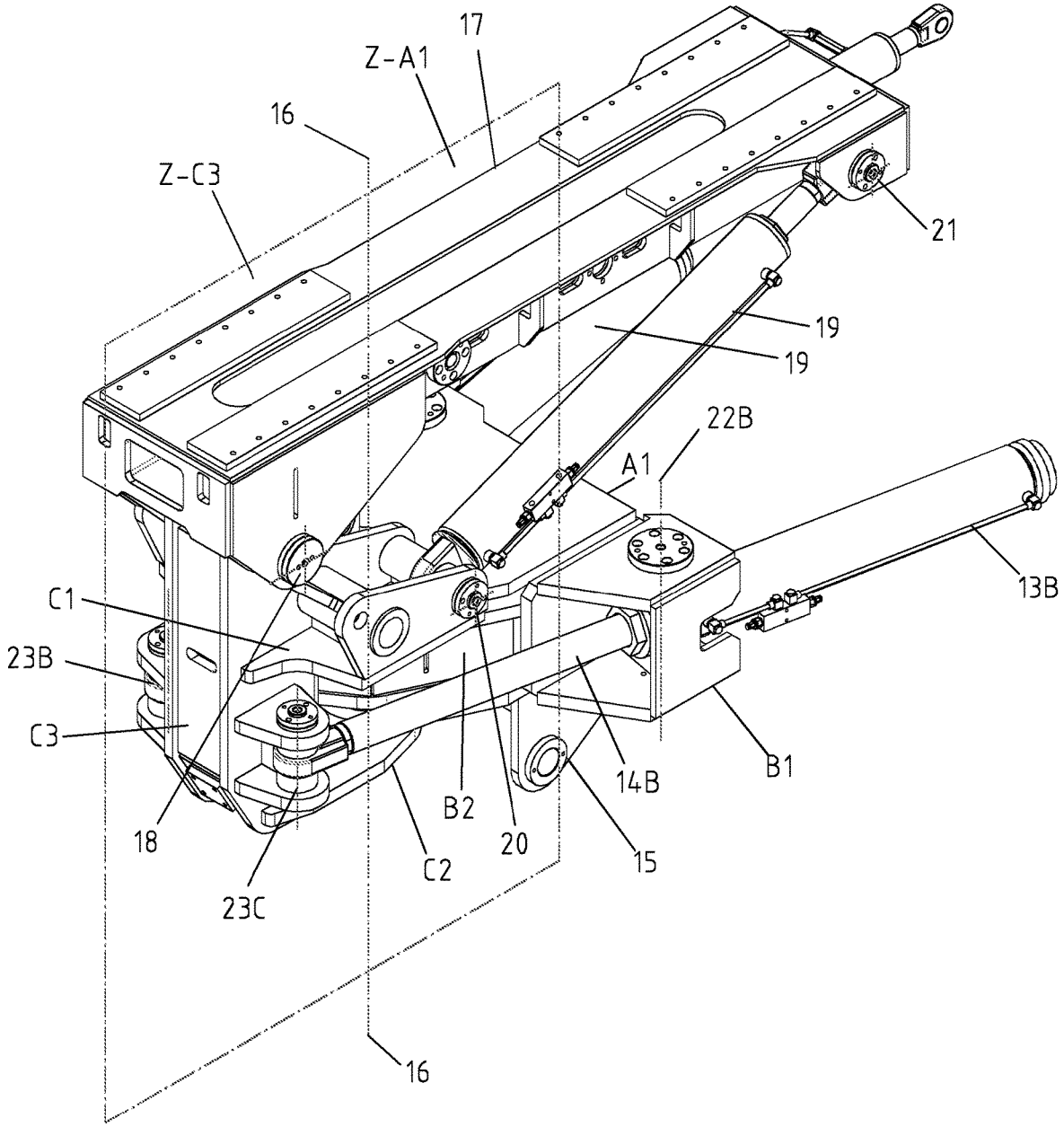
FIG. 5 is a perspective view of the articulated support of FIG. 4 connected to the support of a mast device.

The articulated support 4 of this disclosure allows to determine the angular position of the mast device according to the type of perforation to be performed. When vertical perforations are to be carried out for lateral consolidation of the streets, or of a containment wall placed along the roadside, it would be ideal to place the tracked vehicle 1 longitudinally along the way to be drilled and to rotate by 90° the articulated support as in FIGS. 2 and 3. In this way the mast device is located in front of the wall along the way: this position is called Front The Wall (or FTW). The advantage is to have the drilling machine ready to move along the road with the mast device already rotated or in the drilling position.

Figure 6:
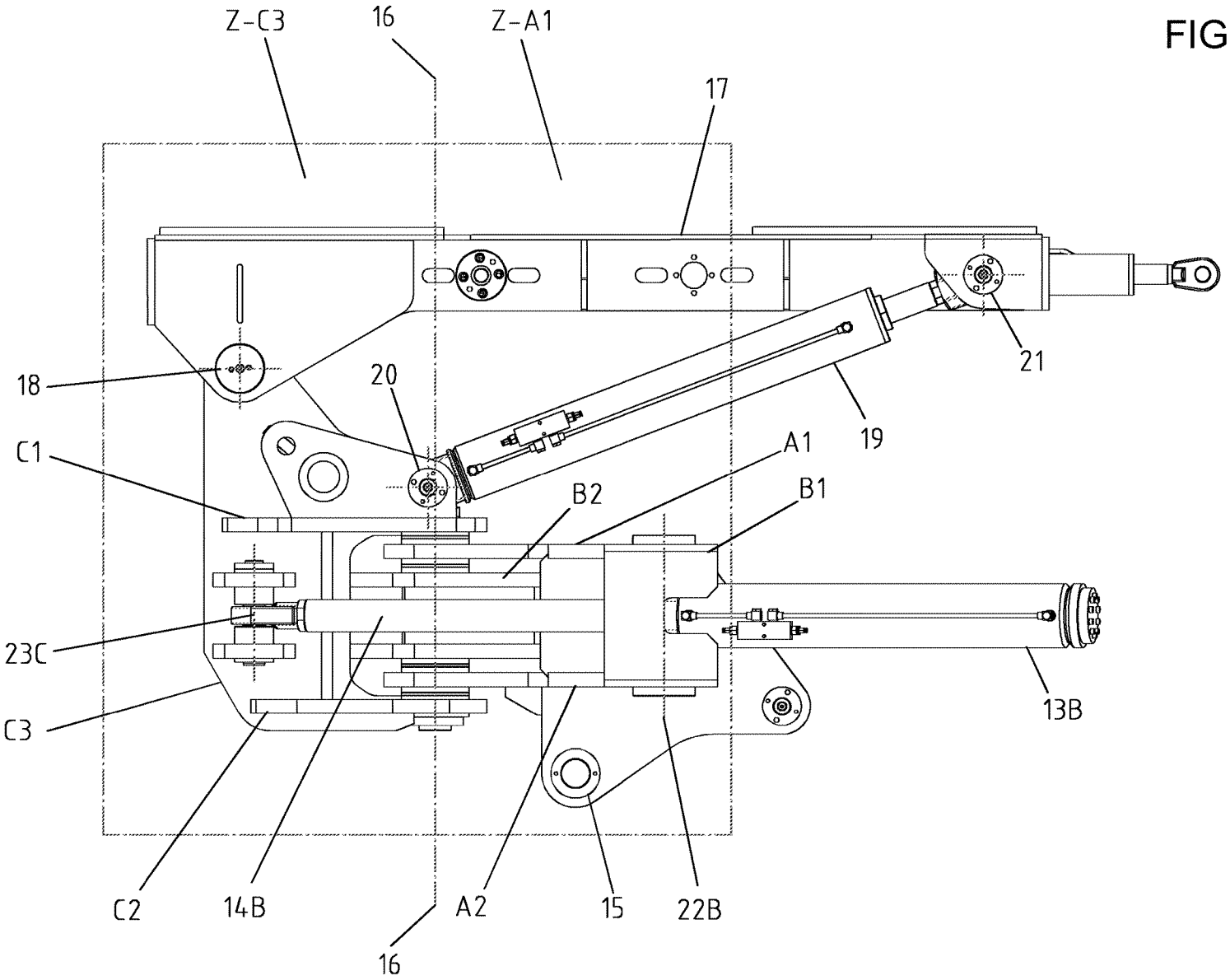
FIG. 6 shows a side view of the articulated support of FIG. 5 connected to the support of a mast device in a retracted configuration.
Figure 7:
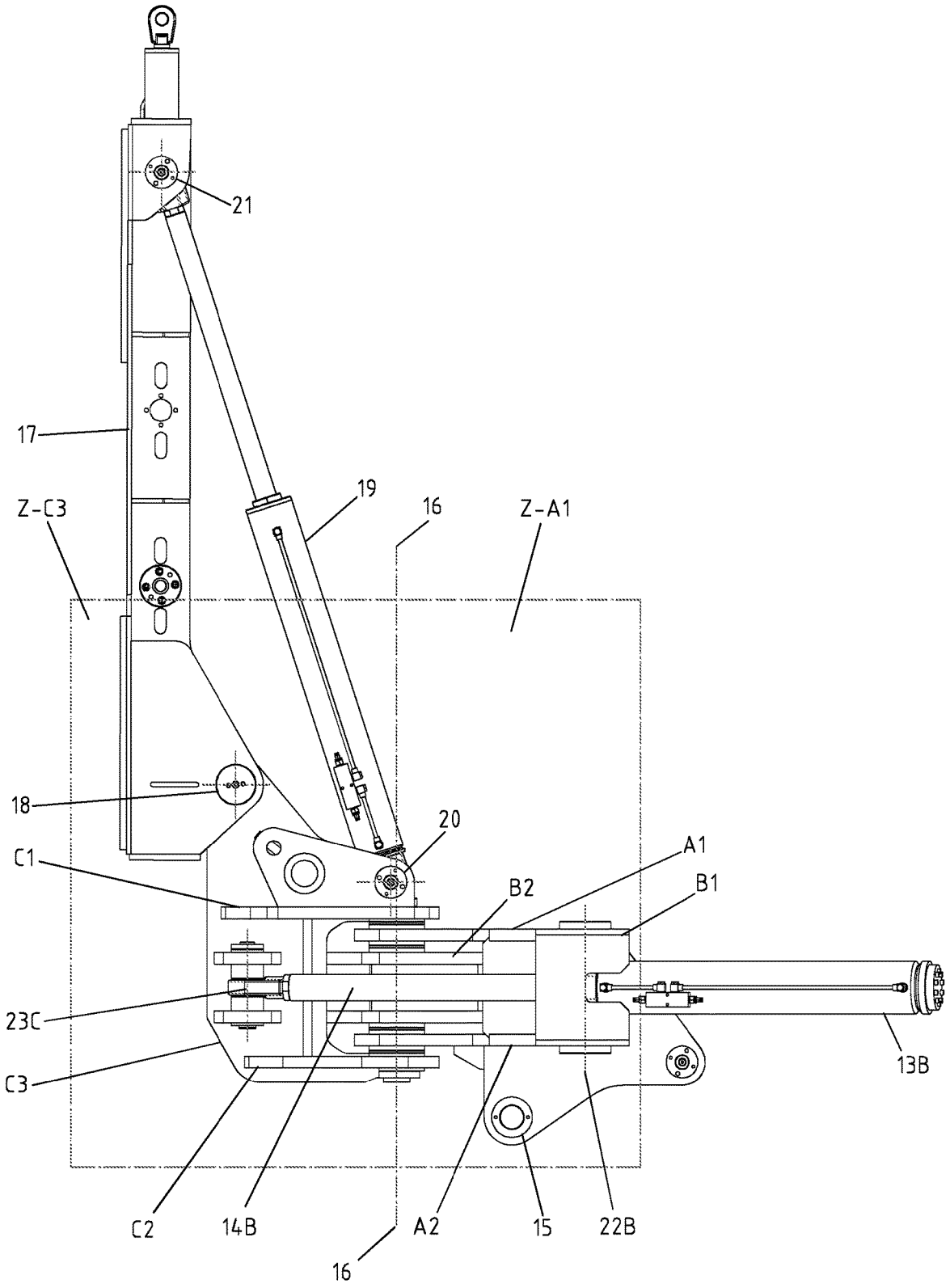
FIG. 7 shows a side view of the mast device of FIG. 5 connected to the support of a mast device in a deployed configuration.

To allow for this by avoiding the problems due to the rotation by 90° of the mast device, the articulated support 4 has been realized, shown in various configuration in the figures from 4 to 10, which substantially comprises a main body A, which is directly supported by the tracked vehicle 1, a first rotatable body B and a second rotatable body C, with the rotating bodies B and C coaxially pivoted on the body A independently of one another. As can be seen better in the side view of FIG. 6, the main body A defines a C-shaped profile with a first flat plate A1 and a second flat plate A2 parallel to each other. On these flat plates A1 and A2 are pivoted independently of one another the two rotating bodies along a main axis of rotation 16 located substantially at the center of the articulated support 4. The main body A preferably has a joint 15 for rotatably connecting the articulated support 4 to the arm 11 and to the linear actuators 12. A first linear actuator, for example a hydraulic actuator, has a cylinder 13A hinged to the plates A1 and A2 on the axis 22A, which is located at a distance from the axis 16, and a piston 14A which slides therein to rotate the second rotatable body C, as will be explained further below.

The first rotatable body B has a beam having a first arm B2 and a second arm B3 and is pivoted to the axis 16 at a substantially central position, so as to rotate with respect to the main body A with the arms B2 and B3 oriented in substantially diametrically opposite directions. At the free end B1 of the first arm B2 the cylinder 13B of a linear actuator is hinged along an axis 22B passing through the free end B1, so that the cylinder 13B can rotate with respect to the first arm B2. The distance of the axis 22B from the axis 16 is substantially the same distance of the axis 22A from the axis 16 so that, when the pistons 14A and 14B are equally extended (FIG. 8), the axes 22A and 22B are in a specular position with respect to at a centerline plane, passing through the axis 16, of the support C3 to which to fix the mast device. At the free end of the second arm B3 is a bar 23B which defines an axis passing through the free end of the second arm B3, to which the piston 14A which slides into the cylinder 13A pivoted on the main body A. As shown in the figures, the bar 23B is positioned so that it and the axis 22A are always on the same side with respect to the centerline plane, passing through the axis 16, of support C3.

A second rotatable body C defines a first flat surface C1 and a second flat surface C2 parallel to each other and held together by the support C3, transversal to them, to which the mast device is constrained. The support 17 of the antenna 7 is pivoted to the support C3 along the axis 18 and is moved by the linear actuators 19 pivoted along the axes 20 and 21 respectively to the support C3 and to the support 17. The first flat surface C1 of the second rotatable body C is pivoted to the first A1 flat surface of the main body A and so the second flat surface C2 is pivoted to the second flat surface C2 coaxially to the surfaces C1 and A1, so that the entire second rotatable body C can rotate with respect to the main body A around the axis 16 independently of the first rotatable body B. A second bar 23C is present, fixed to the support C3 and arranged on the side opposite the bar 23B with respect to the support C3, to which the piston 14B is hinged which slides in the cylinder 13B in its turn pivoted on the first rotatable body B. As shown in the figures, the bar 23C is positioned so that it and the axis 22B are always on the same side with respect to the center plane (shown as Z-C3 and Z-A1), passing through the axis 16, of the support C3. The distance of the bar 23C from the axis 16 is substantially the same distance as the bar 23B from the axis 16 so that, when the pistons 14A and 14B are equally extended (FIG. 8), the bars 23B and 23C are in a specular position with respect to the centerline plane of the support C3 passing through axis 16.

Figure 8:
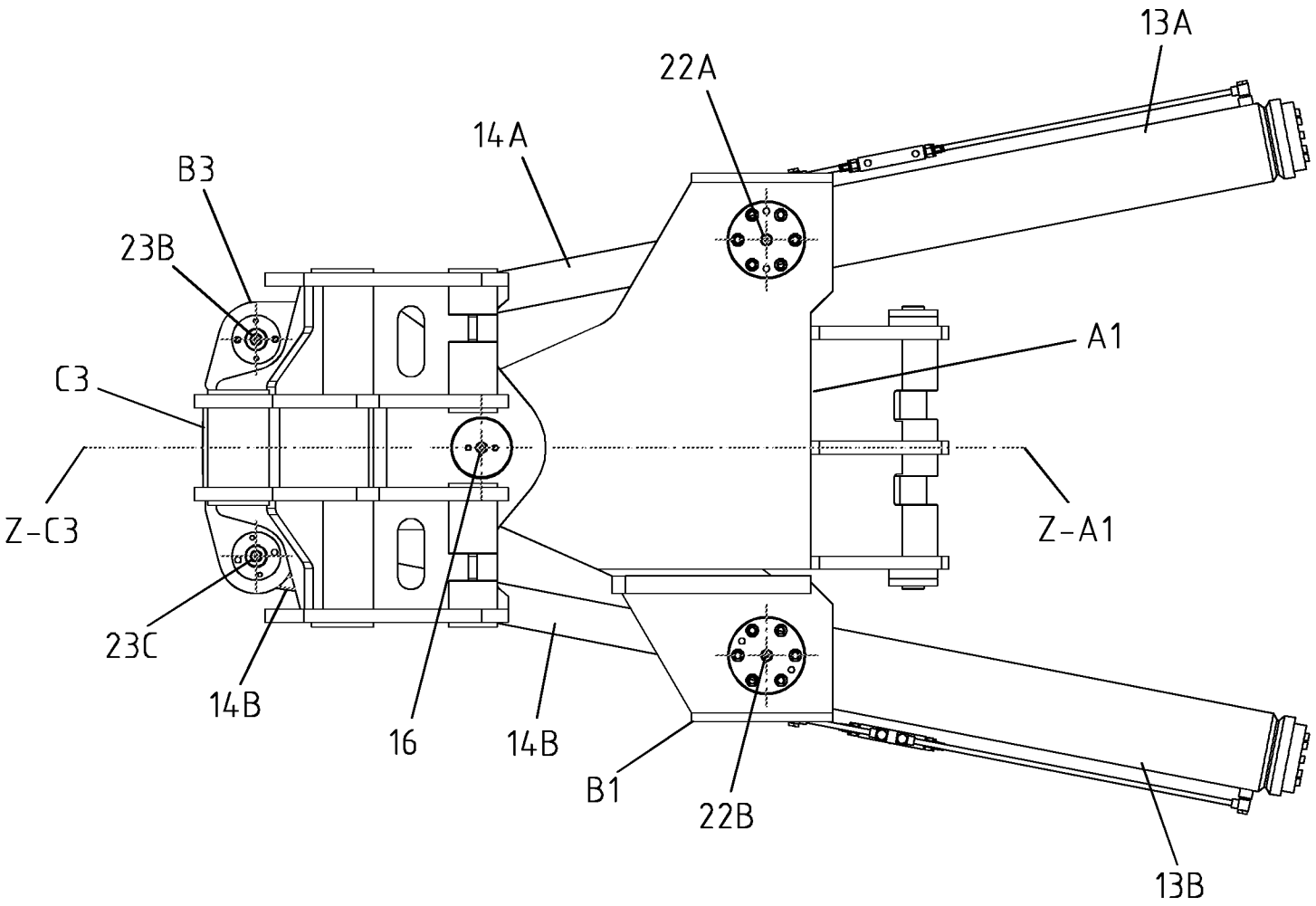
FIG. 8 shows the articulated support of FIG. 4 with the rotation head aligned with a direction of advancement of the tracked vehicle.
Figure 9:
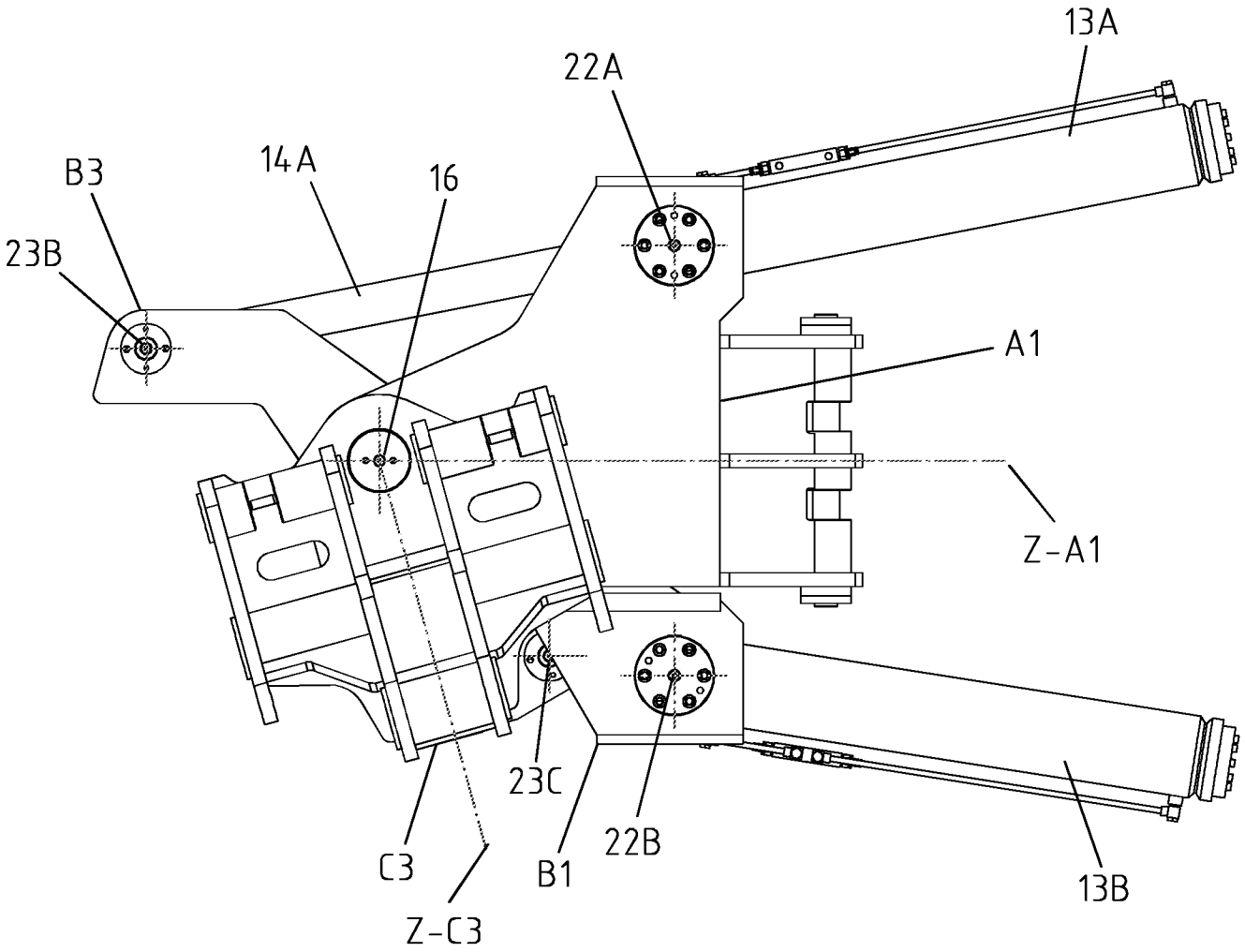
FIG. 9 shows the articulated support of FIG. 4 with the rotation head turned by 90° on a first side of the support.
Figure 10:
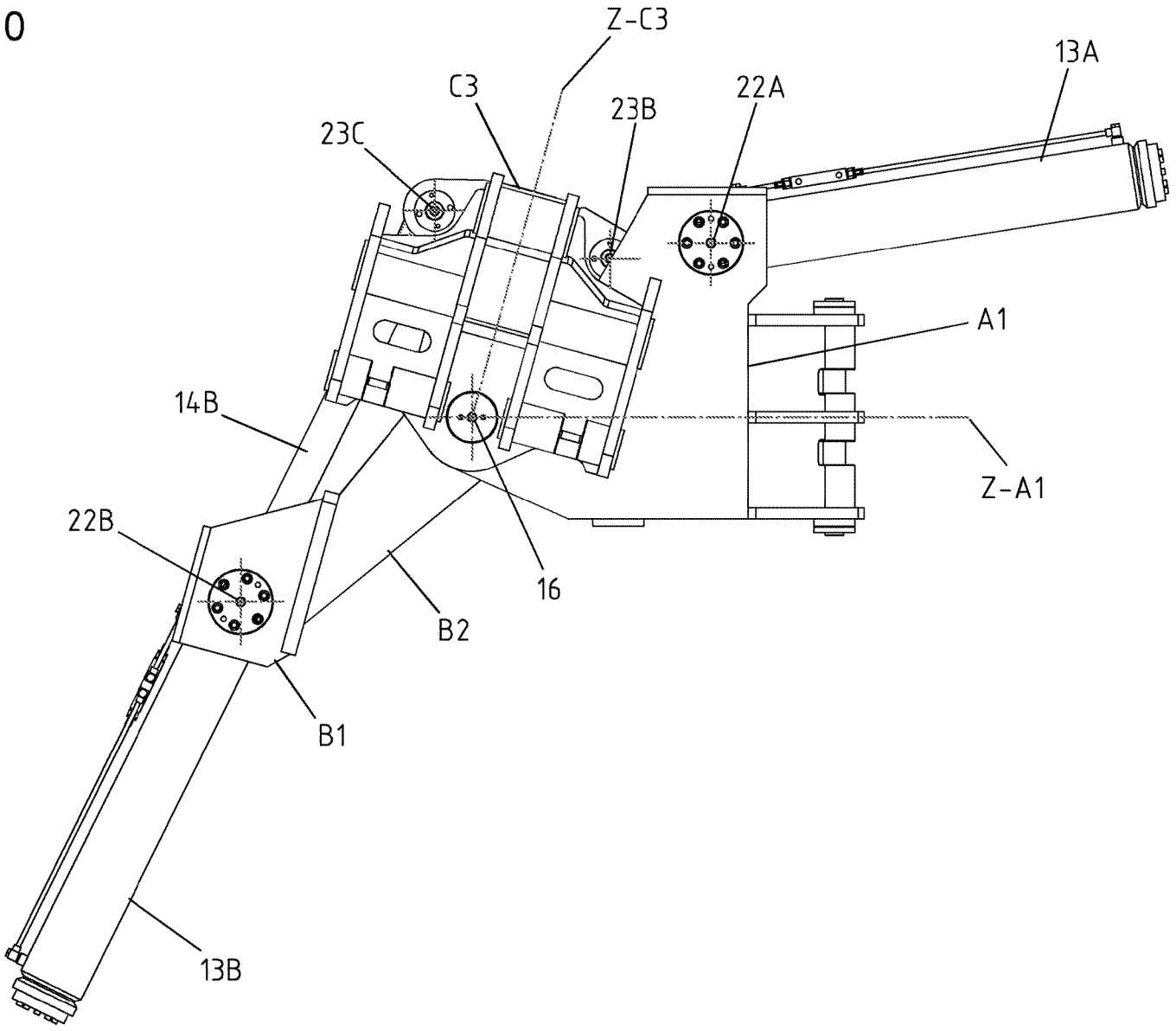
FIG. 10 shows the articulated support of FIG. 4 with the rotation head turned by 90° on a second side of the support.

As shown in the sequence of FIGS. 8, 9 and 10, by sliding the pistons 14A and 14B in the respective cylinders 13A and 13B, hinged respectively to the main body A and to the first rotatable body B, it is possible to rotate the support C3 of the mast device by even more than 180° with respect to the main body A. In the FIG. 8 the pistons 14A and 14B are equally extended, so that the first rotatable body B is close to the main body A and the second rotatable body C is oriented so that the bar 23B and the axis 22A are in a substantially mirror-like position with respect to the bar 23C and to the axis 22B with respect to the center plane (shown as Z-C3 and Z-A1) of the support C3 passing through the axis 16.

Starting from the configuration of FIG. 8, by keeping the piston 14A extended and the piston 14B retracted (FIG. 9), the first rotatable body B remains close to the main body A and the second rotatable body C rotates counterclockwise with respect to the main body A and the first rotatable body B. Vice versa, by extending the piston 14B and retracting the piston 14A (FIG. 10), the second rotatable body C does not rotate with respect to the first rotatable body B, but the latter rotates clockwise with respect to the main body A and therefore rotates the second rotatable body C clockwise with respect to the main body A.

It is understood that, in all possible configurations, the pistons 14A and 14B can never be aligned with the rotation axis 16, so it will never happen to have to disconnect one piston when the mast device must be rotated. Moreover, the forces exerted by the pistons always have a non-null lever with respect to the rotation axis 16 of the support C3, thus the pistons will always exert a non-zero rotation momentum.

The invention claimed is:

1. An articulated support for moving a drilling mast of a drilling machine, comprising:

a main body;

a first rotatable body, having a beam pivoted in a substantially central position to said main body around a main axis of rotation, said beam defining a first arm and a second arm oriented in directions radially opposite with respect to said main axis of rotation;

each arm of said first arm and said second arm having a free end, wherein the free end of the first arm is substantially diametrically opposed with respect to the free end of the second arm in respect to said main axis of rotation;

a second rotatable body having a support suitable for supporting said drilling mast, wherein said second rotatable body is pivoted to the main body around said main axis of rotation so as to be able to rotate with respect to the main body independently of said first rotatable body;

a first linear actuator having a first cylinder and a first piston sliding in said first cylinder, wherein said first cylinder is pivoted to said main body around a first axis and said first piston is pivoted to the free end of said first arm around a second axis passing through the free end of said first arm;

a second linear actuator identical to said first linear actuator, having a second cylinder and a second piston, sliding in said second cylinder, wherein said second cylinder is pivoted to the free end of said second arm about a third axis passing through the free end of said second arm, and said second piston is functionally pivoted to said support about a fourth axis;

wherein said first axis, second axis, third axis and fourth axis are parallel to each other and radially arranged around said main rotation axis, so that:

said second axis and third axis are substantially diametrically opposite in respect to said main rotation axis, said first axis and fourth axis are at opposite sides in respect to said beam, when said first piston and second piston are at a maximum extension outside the respective first cylinder and second cylinder, said first axis and second axis are on a first side with respect to a center plane of said support passing through said main rotation axis and said third axis and fourth axis are on a second side opposite the first side with respect to said center plane.

2. The articulated support of claim 1, wherein:

the main body defines a first flat plate and a second flat plate parallel and fixed between them;

the first rotatable body has said beam pivoted in a substantially central position to said first flat plate and to said second flat plate around the main axis of rotation orthogonal to said first and second flat plates; and the second rotatable body has a first flat plate and a second flat plate parallel and fixed to each other and fixed to said support, wherein said first and second flat plates of the second rotatable body are respectively pivoted to the first flat plate and second flat plate of the main body around said main axis of rotation so as to be able to rotate with respect to the main body independently of said first rotatable body.

3. The articulated support according to claim 1, wherein said first axis, second axis, third axis and fourth axis are defined so that, when said first piston and second piston are at said maximum extension, the first axis is in a position mirroring the third axis with respect to said center plane and the second axis is in a position mirroring the fourth axis with respect to said center plane.

4. The articulated support according to claim 1, further comprising a first bar fixed to the free end of said second arm and which rises from the second arm along said second axis, and a second bar fixed to said support and arranged along said fourth axis, said first piston being pivoted to the first bar and said second piston being pivoted to the second bar.

5. The articulated support according to claim 1, wherein said linear actuators are hydraulic actuators.

6. The articulated support according to claim 1, further comprising a joint fixed to said main body and configured for rotatingly connecting the articulated support to a support means of a motor vehicle.

7. A drilling machine, comprising:

a device having at least one guide antenna, a carriage sliding along said guide antenna, a rotation head fixed to the carriage configured to rotate a drill rod;

the articulated support according to claim 6, wherein said device is fixed to the support of the second rotatable body of the articulated support;

the motor vehicle having support means functionally connected to the joint of said articulated support.

* * * * *